United States Patent [19]

Pickel

[11] Patent Number: 4,824,388

[45] Date of Patent: Apr. 25, 1989

[54] MALE OR FEMALE CONNECTOR FLOATINGLY MOUNTED IN A MOUNTING PLATE

[75] Inventor: Wolfgang Pickel, Stuttgart, Fed. Rep. of Germany

[73] Assignee: Alcatel N.V., Amsterdam, Netherlands

[21] Appl. No.: 193,917

[22] Filed: May 13, 1988

[30] Foreign Application Priority Data

May 14, 1987 [DE] Fed. Rep. of Germany ..... 3716152

[51] Int. Cl.[4] ..... H01R 13/64

[52] U.S. Cl. ..... 439/248; 439/551; 285/223; 403/4; 403/194

[58] Field of Search ..... 439/246–252, 439/534, 550, 551, 562, 563, 565; 285/223; 403/4, 194

[56] References Cited

U.S. PATENT DOCUMENTS 4,558,972 12/1985 Coller et al. ..... 439/246

FOREIGN PATENT DOCUMENTS 3527914 2/1987 Fed. Rep. of Germany .

634658 3/1950 United Kingdom ..... 285/223

OTHER PUBLICATIONS

F. Schmalzl et al., "10 Jahre Vertikalbauweise 7R", ez, Aug. 6, 1976.

*Primary Examiner*—Gary F. Paumen

*Attorney, Agent, or Firm*—Christie, Parker & Hale

[57] ABSTRACT

A male or female connector (1) is mounted with radial play in an opening (8) of a mounting plate (6) whose thickness decreases uniformly in opposite directions from the center axis (11) of the opening (8). The male or female connector (1) can be tilted about the edge thus formed, so that it can align with a complementary connector half whose insertion axis deviates from the direction of insertion.

5 Claims, 1 Drawing Sheet

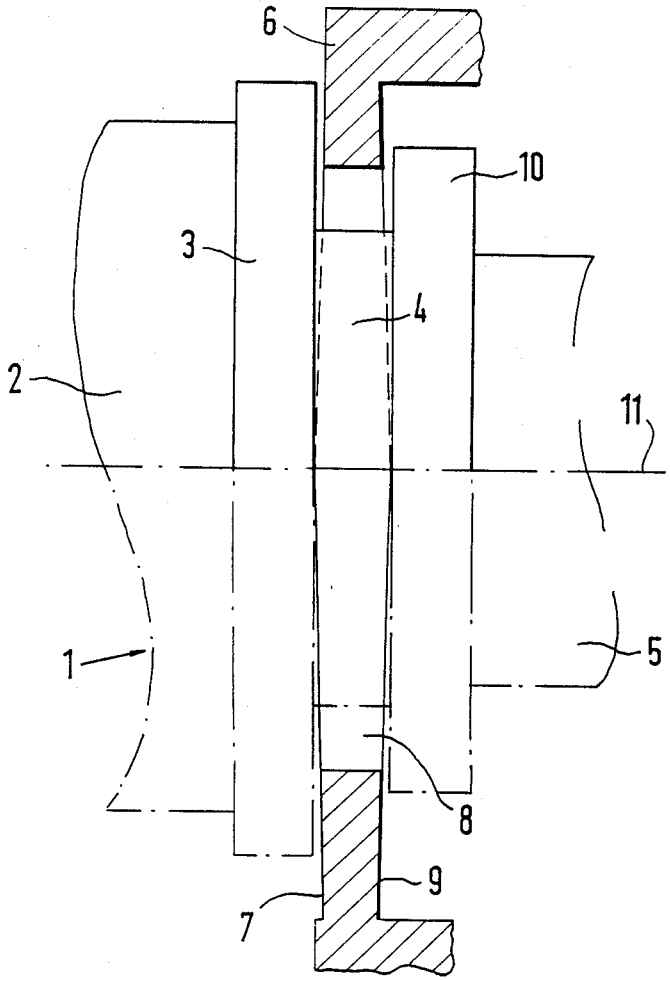
6
10
3
4
2
11
1
5
8
9
7

MALE OR FEMALE CONNECTOR FLOATINGLY MOUNTED IN A MOUNTING PLATE

TECHNICAL FIELD

The present invention pertains to a mounting plate having at least one opening and a male or female connector floatingly mounted in the opening. Such arrangements are used in communications equipment.

CLAIM FOR PRIORITY

This application is based on and claims priority from an application first filed in Federal Republic of Germany on 14 May 1987 under serial number P 37 16 152.0. To the extent such prior application may contain any additional information that might be of any assistance in the use and understanding of the invention claimed herein, it is hereby incorporated by reference.

BACKGROUND ART

Such communications equipment has been standardized by the German Federal Postal Administration, for example, under the designation "Bauweise 7R". As is disclosed in published German patent application No. 35 27 914, at the supports or uprights of a rack which is designed to receive subracks, devices for receiving such subracks are fixed one above the other at the necessary intervals. The devices for receiving subracks have guide bars for inserting subracks and are provided with connectors which cooperate with complementary connectors of the inserted subracks.

The connectors of each subrack-receiving device are floatingly mounted in a conventional manner in holes of a mounting plate which is formed, for example, by a U-shaped sheet-metal bar and which in turn is screwed up, for example, a cable support of the subrack-receiving device. The male and female halves of such connectors are designed, for example, to provide connections for coaxial cables or, increasingly, optical waveguides.

A special aspect of the 7R equipment practice is that the height of the subracks is usually equal to a multiple of their width or depth and that therefore the danger of tilt is increased when they are inserted into the subrack-receiving devices. Axially parallel deviations of the connectors in relation to each other are compensated for by mounting them in a floating manner. Compensation is not possible, however, if, as a result of a tilting motion by the subrack about the lower front edge, the connector is brought into a tilted position in which its axis deviates from the insertion axis; it can thus cause misalignment. However, in optical waveguide connectors, attenuation in the connection increases dramatically if the insertion axes of the connectors to be joined are not in precise alignment.

DISCLOSURE OF INVENTION

It is a primary object of the invention to improve the floating mounting for a connector in such a manner that axial alignment with a complementary connector is possible even if the insertion axis of the latter deviates from the direction of insertion. In accordance with the invention, this object is achieved by a floatingly mounted connector with a shoulder portion within an opening of a mounting plate whose thickness varies from that of the shoulder at the center axis of the opening to a decreased thickness at two opposing edge of the opening.

BRIEF DESCRIPTION OF DRAWINGS

An embodiment of the invention will now be described with reference to the drawing, which is a partly sectional side view of part of a schematically shown connector which is floatingly mounted in a mounting plate.

BEST MODE FOR CARRYING OUT THE INVENTION

In the drawing, reference numeral 1 generally designates a connector. The connector can be any design for connecting wires, or, as shown in the embodiment described herein, a connector in accordance with DIN 47 257 for connecting optical waveguides. The connector 1, which can be a male or a female connector, has a housing 2 with a collar 3, followed at its rear by a shoulder 4 having a reduced diameter, and a threaded shank 5 whose diameter is again reduced. Of course, the shoulder 4 may also be formed by a short distance sleeve which is slipped over the threaded shank 5 in case the latter extends up to the collar 3, or if the mounting plate is thicker than the shoulder 4 is long.

For floatingly mounting the connector 1 in the mounting plate 6, the threaded shank 5 is inserted from the outer side 7 of the plate through an opening 8 until the housing 2 strikes against the mounting plate, and at the rear side 9 of the plate, a nut 10 is screwed against the shoulder 4. Depending on the guide range of the connector 1, the opening 8 has a more or less enlarged diameter in relation to the shoulder 4, so that the connector, from the center axis 11 of the opening 8, has sufficient play for movement in the radial direction.

At the center axis 11, the mounting plate 6 has a material thickness which is equal to the thickness of the shoulder 4 of the connector 1, axial play thus being avoided. In order for the connector 1 to be able to align with a complementary connector which has an acute-angled position in relation to the insertion axis because, for example, the subrack to which it is fixed is tilted, the material thickness of the mounting plate 6 decreases uniformly in opposite directions from the center axis 11 of the opening 8. The decrease in material thickness extends in both directions at least as far as the housing 2 can strike against the outer side 7 of the mounting plate 6. If the material thickness of the mounting plate 6 decreases vertically from the horizontal center axis 11 of the opening 8 in the mounted condition, such symmetrical decrease of material thickness allows the tilted connector 1 to strike against either the upper portion of the housing at the outer side 7 of the plate with the lower portion of the nut 10 against the rear side 9 of the plate, or housing and with the upper portion of nut 10 against the rear side 9 of the plate, depending on the direction in which the connector is tilted.

The embodiment of the floating mounting for connectors is suitable especially for use in the above-mentioned subrack-receiving devices for communications equipment. In a particularly advantageous manner, the mounting plate 6 here is part of a one-piece molded holding frame of plastic material, e.g., of a glass-fiber reinforced thermoplastic material, in which the outer side 7 and the rear side 9 of the plate deviate from a plane intersecting the center axis 11 of the opening 8 at a right angle by 1°. The advantage of using plastic material is that injection-molded parts with close tolerances can be manufactured by a very economical manner.

I claim:

1. A connector floatingly mounted in a mounting plate having an opening through which a rear threaded shank of the connector is inserted from one side of the plate until a housing of the connector strikes against the one side of the mounting plate, the connector being fixed on an other side of the plate by means of a nut screwed against a shoulder of the connector, wherein at a center axis of the opening, the mounting plate has a material thickness which is equal to the thickness of the shoulder of the connector and which decreases in opposite directions from the center axis of the opening.

2. A connector as claimed in claim 1, wherein the material thickness of the mounting plate decreases uniformly.

3. A connector as claimed in either of claims 1 or 2, wherein the material thickness of the mounting plate decreases vertically from the center axis of the opening when the center axis lies horizontally.

4. A floating mounting as claimed in any of claims 1 to 3, wherein the mounting plate is an injection-molded plastic part.

5. A floating mounting as claimed in claim 1, characterized in that the shoulder of the connector is formed by a sleeve which is slipped over the threaded shank.

* * * * *